US005564646A

United States Patent [19]

Clarelli

[11] Patent Number: 5,564,646

[45] Date of Patent: Oct. 15, 1996

[54] WINDING CORE FOR WINDING FLAT OBJECTS

[75] Inventor: Simon Clarelli, Kreuzlingen, Switzerland

[73] Assignee: Feramatic AG, Bürglen, Switzerland

[21] Appl. No.: 385,832

[22] Filed: Feb. 9, 1995

[30] Foreign Application Priority Data

Mar. 8, 1994 [CH] Switzerland ..... 00679/94

[51] Int. Cl.[6] ..... B65M 75/18

[52] U.S. Cl. ..... 242/578.2; 242/609.2

[58] Field of Search ..... 242/578, 578.1, 242/578.2, 578.3, 609, 609.1, 609.2, 609.3, 613.5

[56] References Cited

U.S. PATENT DOCUMENTS

| | | | |
|---|---|---|---|
| 597,956 | 1/1898 | Cocker | 242/609.2 |
| 601,162 | 3/1898 | Pain | 242/578.2 |
| 637,540 | 11/1899 | Welin | 242/578.2 |
| 860,965 | 7/1907 | Davis | 242/578.1 |
| 869,871 | 11/1907 | Barnes | 242/578.1 |
| 893,571 | 7/1908 | Davis | 242/578.1 |
| 2,905,408 | 9/1959 | Frate et al. . | |
| 3,759,460 | 9/1973 | Fyans | 242/578 |
| 3,826,444 | 7/1974 | Hahm | 242/578 |
| 4,101,095 | 7/1978 | Carter | 242/578.1 |
| 4,428,546 | 1/1984 | Weideman . | |
| 4,570,869 | 2/1986 | Tsuji | 242/578.2 |
| 4,832,273 | 5/1989 | Honegger . | |
| 4,867,391 | 9/1989 | Resch . | |
| 5,158,242 | 10/1992 | Honegger . | |
| 5,176,333 | 1/1993 | Stauber . | |
| 5,354,008 | 10/1994 | Honegger . | |

FOREIGN PATENT DOCUMENTS

| | | |
|---|---|---|
| 3312178 | 10/1984 | Germany . |
| 3509337 | 9/1986 | Germany . |
| 3835174 | 4/1990 | Germany . |
| 643800 | 6/1984 | Switzerland . |
| 710211 | 6/1954 | United Kingdom . |
| 1354959 | 5/1974 | United Kingdom . |
| 2179627 | 3/1987 | United Kingdom . |
| 2182314 | 5/1987 | United Kingdom . |
| 8912017A1 | 12/1989 | WIPO . |

*Primary Examiner*—John P. Darling
*Attorney, Agent, or Firm*—Spencer & Frank

[57] ABSTRACT

A winding core for winding flat articles. The winding core is substantially cylindrical and hollow and thereby defines a longitudinal axis and a cylinder cavity. The winding core is further rotatable about the longitudinal axis, includes a retaining device disposed in the cylinder cavity, and is symmetrical with respect to a plane of symmetry S perpendicular to thee longitudinal axis. The winding core is configured such that its height is adjustable by varying in the axial direction one of a circumferential surface of the winding core and gap heights of gaps defined in the circumferential surface of the winding core.

20 Claims, 7 Drawing Sheets

WINDING CORE FOR WINDING FLAT OBJECTS

FIELD OF THE INVENTION

The invention relates to a winding core unto which are wound in overlapping manner with the aid of a winding band flat objects and in particular printed products.

BACKGROUND OF THE INVENTION

Printed products are often supplied in the form of scale flows, that is in such a way as to partly overlap one another, from processing stations, for example from rotary systems. If such printed products are not immediately continuously further processed, it is appropriate to intermediately store them in such a way that the scale flow order can be retained. For this purpose it is appropriate to intermediately store in rolls, which represent a limited scale flow wound onto a winding core with the aid of a winding band or tape and said scale flow can again be supplied to the processing operation by simply unwinding. Winding stations for winding on and off printed products in scale formation are known, for example from European Pat. No. 447903 corresponding to U.S. Pat. No. 5,158,242 or from European Pat. No. 477498 corresponding to U.S. Pat. No. 5,176,333.

Using the same or similar winding stations and winding cores it is obviously not only possible to wind on and off printed products, but in general terms flat objects which can be bent without damage about a corresponding radius.

The aforementioned winding stations are operated together with substantially hollow cylindrical winding cores, onto which the winding tape is fixed at its one end. Such winding cores are for example, described in European Pat. No. 236561 corresponding to U.S. Pat. No. 4,832,273. The winding tape is wound onto the empty roll and is unwound prior to the winding on of the printed products. Both the winding cores and the rolls are gripped in the cylinder space or cavity of the core for bringing to winding stations, for removing from winding stations and also for manipulation during storage and storage removal. Therefore within this space are also fitted retaining means, for example in the form of a projection running round the inner circumference. In order to make it unnecessary to take note of the orientation of the core during manipulation, it is appropriate to position the retaining means in such a way that the core has a plane of symmetry perpendicular to its axis.

The rolls can be stored in superimposed manner. However, this means that in the axial direction the core must have the same or a smaller extension length than the wound on printed products, because only in this way are stable roll stacks obtained. In order that the same cores can be used for rolls of printed products of different widths, it is advantageous to dimension them in such a way that their axial extension that is, their axial length is at the most the same as the identical extension of the narrowest of the products to be wound. However, as a result in rolls of wider products the outer areas of the products are not supported by the winding core, which can lead to undesired deformations, particularly in the case of sensitive products and during prolonged storage. In addition, said outer areas can, during manipulation, which generally involves gripping in the core cavity, be damaged, which is also not desired.

European patent application 453765 corresponding to U.S. Pat. No. 5,354,008 of thee same applicant describes winding cores, whose axially outer areas are constructed in the form of spaced projections. Such cores or corresponding rolls of printed products, which are narrower than the core, are stacked in such a way that the projections of one core engage in the gaps between the projections of the core below it. This leads to very stable stacks and the printed products are also supported by the core in their outermost areas and this applies to different printed product widths within certain limits. However, stacking must be performed very carefully, because the projections must be very accurately aligned with the spaces and even minor divergences from a precisely coaxial position of the rolls to be stacked on one another can lead to damage to the product edges in the spaces between the projections.

SUMMARY OF THE INVENTION

The object of the present invention is to provide a winding core on which it is possible to wind flat objects of different widths (in the axial direction on the core), in such a way that also the axially outer areas of the articles in the roll are always supported by the winding core, so that such winding cores and rolls with such edges can be stacked on one another without any problems and without any particular care or safety precautions. The winding on and off of the winding tape fixed to the winding core, as well as all manipulations of the core or the roll can be performed in the same way as with the known winding cores.

The axial extension of the winding core according to the invention can be adjusted in accordance with the width of the product to be wound on, namely whilst maintaining the plane of symmetry of the core. Thus, in other words, the axial extension or axial length of at least the outer circumferential surface of the hollow cylinder defining a longitudinal axis, which forms the support element for the wound on printed products, is adjustable symmetrically on either side within certain limits. This can be brought about in different ways, namely by attaching corresponding enlargement rings to a core with a minimum cylinder height or clearance volume, by adjusting the axial length or gap length of interruptions or gaps provided in the circumferential surface, or by folding down correspondingly designed circumferential surface parts. It is noted that throughout the application, a height of a component refers to the same dimension as the axial length of the component.

No significant axial forces act on the circumferential surface of the winding cores supporting the printed products either during winding (horizontal roll axis that is, the longitudinal axis oriented horizontally) or during the storage of the rolls with a horizontal roll axis. If the rolls are stored with a vertical axis, i.e. positioned horizontally, once again no significant axial forces occur on the winding cores, if the axial extension of the core is no greater than that of the printed products and the core is positioned precisely centrally in the roll. The axial loading of the core increases during storage with a vertical roll axis in an immediate manner, if the latter projects out of the roll in the axial direction to even a limited extent. The embodiments of the winding cores according to the invention described hereinafter are differently loadable in the axial direction, i.e. as a function of the embodiment and use (type of storage), the adjustment of the cylinder height must be very precise or less precise.

The forces acting radially on the winding core are the tension of the winding tape, which acts from all sides, and in the case of a horizontal roll axis the weight of the printed products over the core. Both these forces are reduced by the centrifugal force during winding. Therefore the radial loading of the axially outer areas of the circumferential surface which is to be adjusted and serve as a supporting surface for the printed products to be wound on, is at a maximum when storing rolls with a horizontal roll axis, particularly if the wound on product is axially stiff, so that the radial force exerted by the tensioned winding tape is distributed over the entire cylinder height.

Typical cylinder heights for the winding of printed products, which are desirable, but in no way restrict the invention, are for example a minimum height of 190 mm and a maximum height of 450 mm, so that the height on either side is to be adjustable by a range of in each case 130 mm.

So that the winding of the winding tape onto the empty winding core is not impaired and in particular so that the adjustment of the cylinder height can take place with the winding tape wound on, the axially central area of the outer circumferential surface onto which the tape is wound with the core empty, is not affected by the adjustment. So as not to impair the manipulation of the empty winding core or the roll, the inner space or cavity of the core is accessible independently of the cylinder height, particularly the usually centrally positioned retaining means therein, i.e. the means necessary for adjusting the cylinder height, or the adjusting means, are externally integrated into the circumferential surface or are located on the outermost periphery of the interior.

Therefore the core according to the invention is advantageously based on a central core, which has a minimum axial extension and in which are located the retaining means.

BRIEF DESCRIPTION OF THE DRAWINGS

The description is given with reference to the attached drawings, which show the embodiments of winding cores according to the invention or parts thereof in each case sectioned along the rotation axis.

DETAILED DESCRIPTION OF THE PREFERRED EMBODIMENTS

Hereinafter certain exemplified embodiments of the winding core according to the invention are described in detail. However, the invention is in no way restricted to the embodiments described and on the basis of which it is easy for the expert to implement numerous other embodiments.

Figure 1:
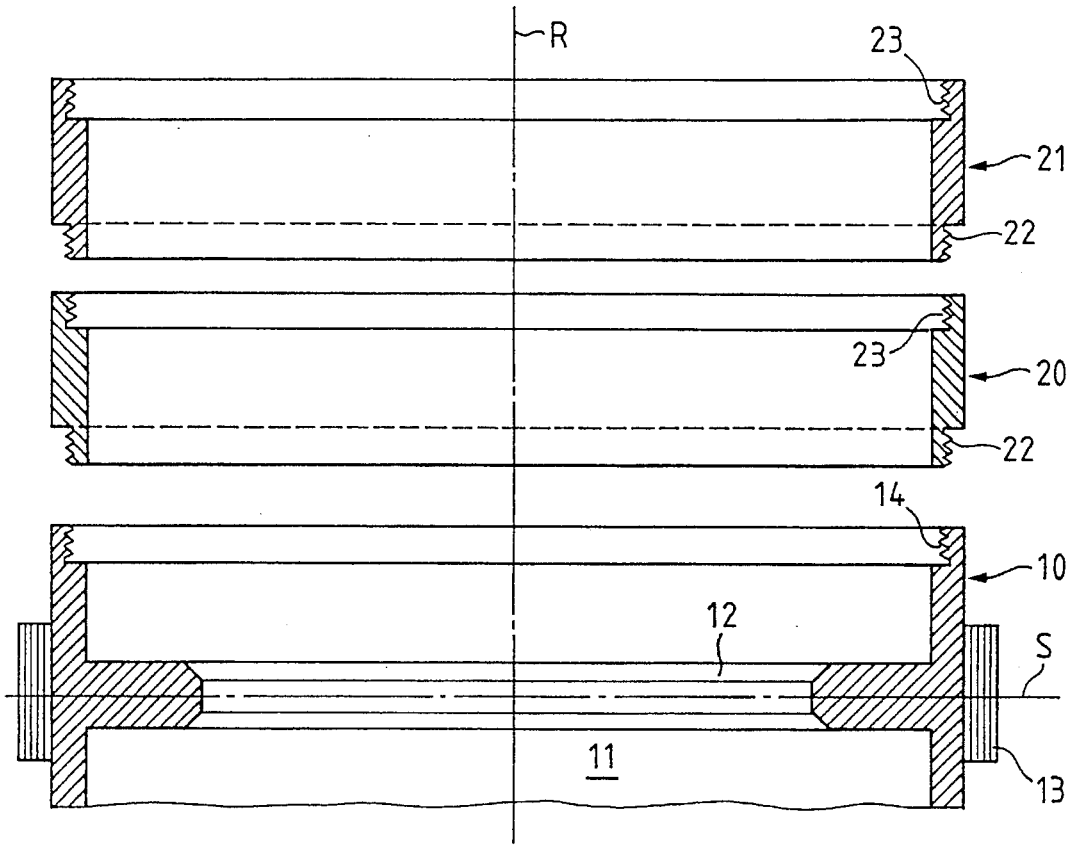
FIG. 1 is a cross sectional view of an exemplified embodiment of a winding core according to the invention including enlargement rings.

FIG. 1 shows an exemplified embodiment of the winding core according to the invention and which for adjusting the cylinder height is provided with enlargement rings. The winding core is shown as a section along the rotation axis R only the core half above the plane of symmetry S is completely shown. This winding core comprises a central core 10, which has in its cylindrical interior 11 retaining means 12 and onto which is wound the winding tape 13, as well as at least one pair of enlargement rings. FIG. 1 shows in each case one of two pairs of enlargement rings 20 and 21. For different, discrete cylinder heights it is possible to use in each case pairs of enlargement rings with different axial extensions, several pairs of enlargement rings with an identical axial extension or corresponding combinations. Therefore the winding core is used without, or with one pair, or with several pairs of enlargement rings.

The internal thread 14 on the central core 10, the internal thread 23 on the enlargement rings 20, 21 and the external thread 22 on the enlargement rings are used according to FIG. 1 as fixing means for fixing the enlargement rings to the central core and further enlargement rings to already fixed enlargement rings. It is also possible to interchange the internal and external threads.

Figure 2:
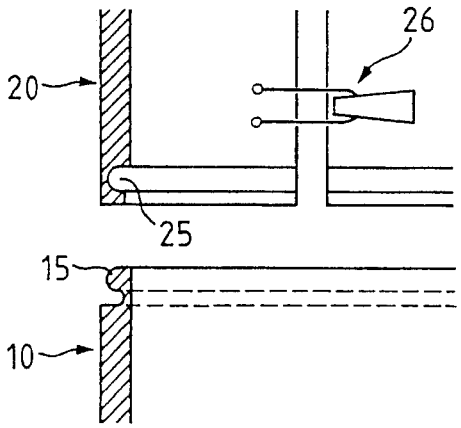
FIGS. 2 and 3 are cross sectional views of the winding core showing variants for fixing the enlargement rings to a central core.

FIG. 2 shows in detail a further exemplified variant of fixing means for the enlargement rings. Here, in place of the internal and external threads of FIG. 1, a groove 25 and a ridge or tongue 15 is provided. If the material from which the enlargement ring 20 and/or the central core 10 are made is sufficiently elastic, then the groove can be snapped by means of an axially acting force over the tongue. If the ring is not elastic, it is open and has over the opening e.g. a rocker closure or catch 26. If the latter is open the diameter of the ring is sufficiently large to move the groove 25 over the tongue 15 and if the groove is over the tongue and the rocker closure is closed, then the ring is fixed to the central core or correspondingly to another ring. In the embodiment according to FIG. 2 it is not necessary for the groove and/or tongue to extend around the entire circumference of the central core and the enlargement ring.

Figure 3:
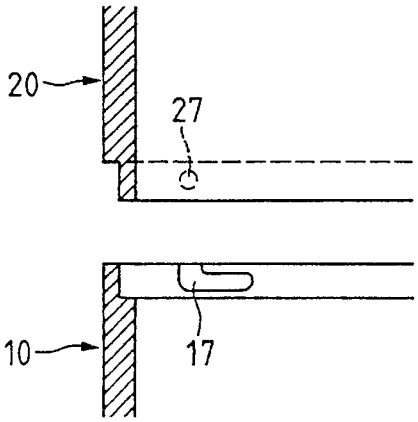

FIG. 3 shows as a further exemplified fixing means between the central core 10 and the enlargement ring 20 a bayonet catch, comprising mouldings 27 and correspondingly shaped recesses 17, which are in each case fitted to the enlargement ring 20 or central core 10.

The advantage of the embodiments of the winding core according to the invention with the enlargement rings according to FIGS. 1 to 3 is that in each case the circumferential surface of the winding core is uninterrupted except for the very narrow gaps between the central core 10 and the enlargement rings 20 and between the different enlargement rings 20, 21. It is also possible to use such a winding core for very sensitive printed products on which larger circumferential surface interruptions would leave behind tracks. Another advantage of the embodiments according to FIGS. 1 to 3 is that they can be designed for maximum loading in the axial and radial direction, i.e. they can for example also be used for applications with two winding tapes. The adjustment to different cylinder heights is complicated to the extent that the enlargement rings constitute separate parts, which require a correspondingly favourable storage location, so that they can always be easily found and reached.

FIGS. 4 to 10 show exemplified embodiments of the winding core according to the invention, whose cylinder height is adjustable continuously or in discrete values by adjusting at least one interruption or gap provided in the circumferential surface and which consequently does not require parts needing replacement (different extension or enlargement rings according to FIGS. 1 to 3). The core comprises a central core and at least one pair of adjusting rings adjustably positionable relative to the central core and which advantageously are not completely separated from the central core for normal handling. Adjusting rings and central core overlap one another and the axial extension of this overlap or overlapping interconnection is adjustable with the aid of corresponding connecting means. The overlap extends either over the entire circumference of the core or only over parts thereof.

As all the embodiments according to FIGS. 4 to 10 (like FIGS. 11 to 19) have interruptions of the circumferential surfaces, into which the innermost layers of the wound on printed products are pressed, they are less suitable for applications with sensitive products and high radial loading, particularly if the interruptions are wide and deep.

Figure 4:
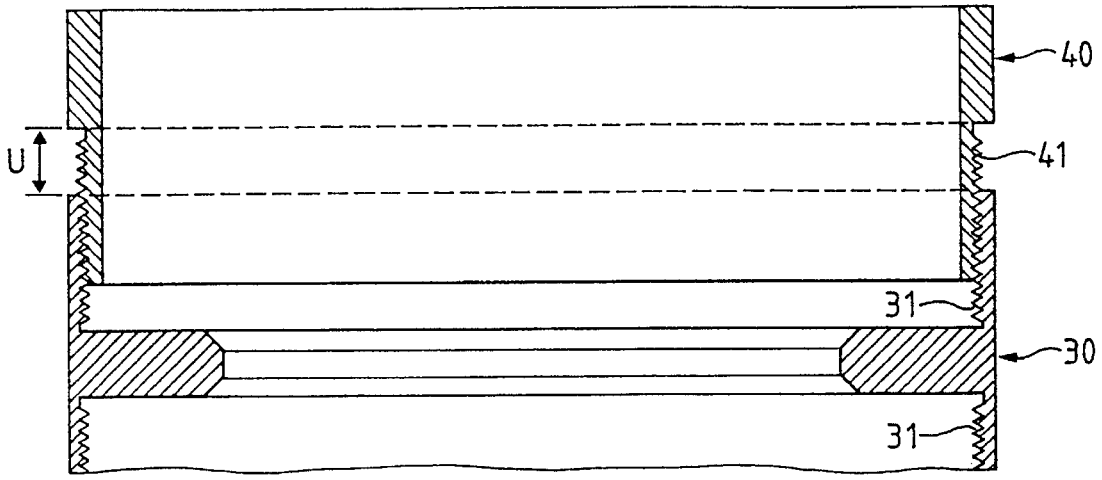
FIG. 4 is a cross sectional view of an exemplified embodiment of the winding core according to the invention showing an adjustable overlap of the central core and adjusting rings.

FIG. 4 shows an embodiment in which the central core 30 and the adjusting rings 40 overlap and the overlap is adjustable with the aid of a thread. On either side or end thereof the central core 30 has an internal thread 31, which has an axial extension substantially corresponding to the desired maximum increase of the cylinder height. The adjusting rings 40 have a corresponding external thread 41. The cylinder height is continuously adjustable by means of the degree with which the rings are introduced into the central core, the circumferential surface having a correspondingly wide interruption. As a result of a self-locking feature of the thread, the above embodiment requires no fixing means in order to fix the adjusting rings for a specific cylinder height. However, it is advantageous to design the thread in such a way that the adjusting rings cannot be completely unscrewed.

Embodiments according to FIG. 4 can also be conceived with more than one ring pair, the axially inner rings then having on the end opposite to the external thread an internal thread in the same way as the central core. With an embodiment having several pairs of adjusting rings undesirably wide interruptions of the circumferential surface can be avoided.

As mentioned in conjunction with the embodiment according to FIG. 1, here again the internal and external threads can be interchanged.

FIGS. 5 to 10 show further variants of connecting means between the central core 30 and enlargements rings 40 with an adjustable overlap, which connecting means can also be used between different enlargement rings.

Figure 5:
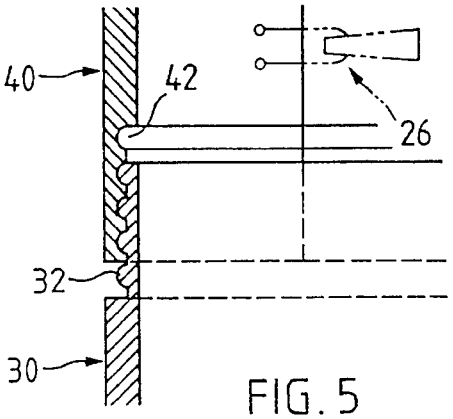
FIGS. 5 to 10 are cross sectional views of the winding core showing variants for adjustable fastenings between the overlapping central core and the adjusting ring or overlapping adjusting rings.

In the same way as FIG. 2, FIG. 5 shows grooves 42 and ridges or tongues 32, whereof in each case (as shown) an identical number can be provided and which either function as an elastic self-closure or in conjunction with a rocker closure 26. It is also conceivable to provide a single tongue and a plurality of grooves (or vice versa) and for the tongue or tongues not to extend over the entire circumference. The arrangement of the grooves and tongues internally or externally on the central core or ring are randomly interchangeable. With the adjustable connecting means according to FIG. 5 an adjustment of discrete cylinder heights is possible.

Figure 6:
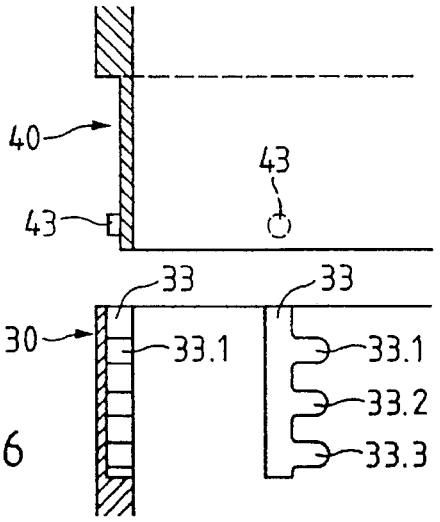

In the same way as FIG. 3, FIG. 6 shows a bayonet catch as a connection between an adjusting ring 40 and a central core 30 with an adjustable overlap, which permits an adjustment of for example three discrete cylinder heights. The bayonet catch comprises mouldings 43 and correspondingly stepped recesses 33, so that the mouldings 43 can be randomly introduced and locked at different steps 33.1, 33.2 and 33.3.

Figure 7:
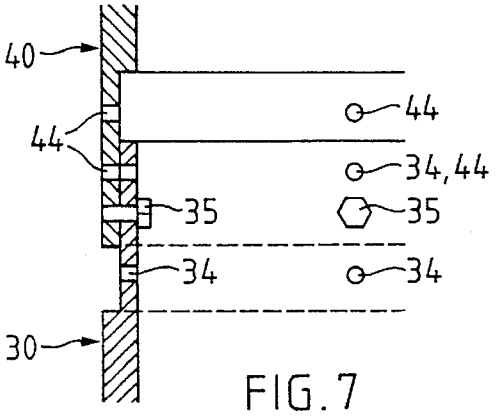

FIG. 7 shows a plug connection between the overlapping central core 30 and adjusting ring 40. For this purpose in the overlap area on the adjusting ring and central core are provided rows of holes 34, 44 through which, if they coincide with one another, is placed a guide pin 35 in order to fix a specific cylinder height of the winding core. Two guide pins per adjusting ring are sufficient. The guide pins are advantageously elastically deformable in such a way that they can be inserted and extracted with an acceptable amount of force, but do not drop out of the holes of their own accord.

Figure 8:
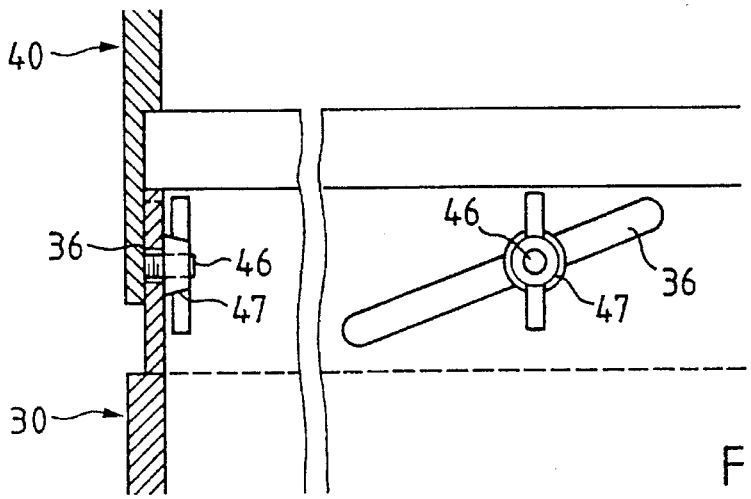

FIG. 8 shows an embodiment of the adjustable connection between the overlapping central core 30 and adjusting ring 40 based on mouldings 46 movable in slots 36 in the overlap area between the adjusting ring and the central core. As is diagrammatically shown, the slots 36 can be spirally arranged, so that a screwing movement is performed for adjustment purposes. The slots can also run axially. For fixing the core with a specific cylinder height the mouldings 46 are for example provided with a thread on which are provided fixing nuts, such as wing nuts 47, which are tightened for fixing purposes. As the wing nuts must be on the inside of the core, it is advantageous to fit the moulding on the outwardly overlapping part (central core or adjusting ring) and the slots on the inwardly overlapping part.

If the central core 30 and adjusting ring 40 match one another sufficiently well for the axial extension of the overlap to be adjustable with an acceptable degree of force, but so that in use, when no significant axial forces act on the core, no automatic movement can take place, then no fixing means are necessary. The core according to FIG. 9 can be handled in the same way as the core with the adjusting threads according to FIG. 4.

Figure 9:
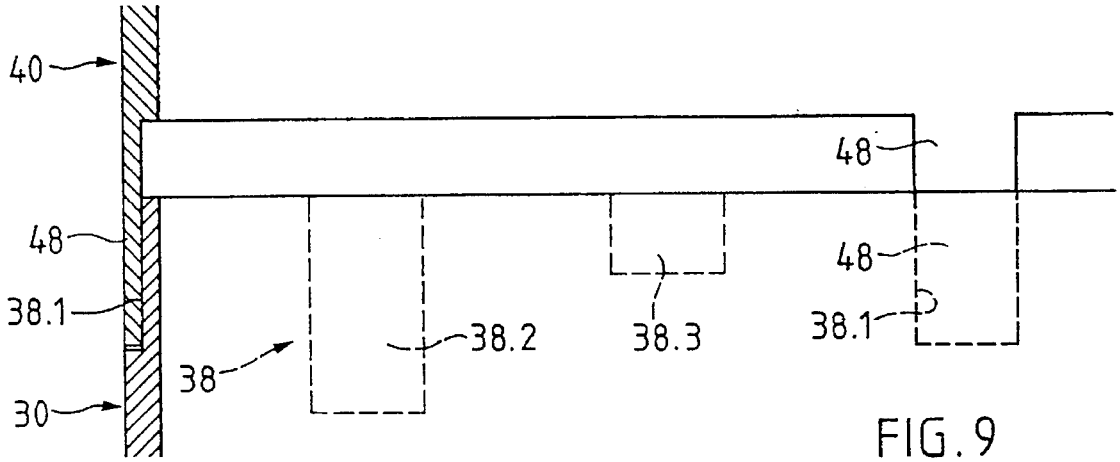

FIG. 9 shows an embodiment which also has a central core 30 and adjusting rings 40, which overlap one another and very closely adapt to one another. The central core 30 has in the overlap area regularly arranged recesses or passages 38 (38.1 38.2 38.3,) groups or sets of such passages defining different axial extensions therebetween and identical axial extensions within one set. The adjusting ring 40 has mouldings 48 corresponding to the recesses and which define groups or sets of moldings having different axial extensions therebetween and identical axial extensions within one set and whereof the same recesses, in the same axial extension. As a function of the rotation position in which the adjusting ring is engaged on the central core, the complete core has a different cylinder height. The moldings and corresponding recesses or passages thereby define discrete connection sets.

Figure 10:
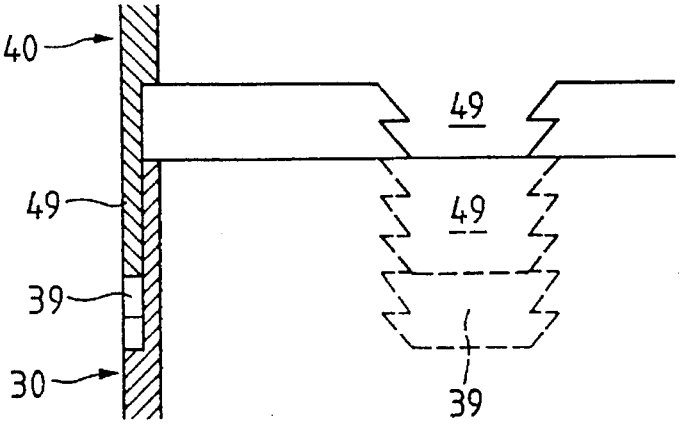

FIG. 10 shows adjustable overlaps between the adjusting ring 40 and the central core 30 with elastically deformable mouldings 49 on the ring 40 which engage in corresponding recesses 39 on the central core 30, the moulding and the recess having axially fitting, stepped boundaries, for example pine tree-shaped tooth systems, which as a function of the set cylinder height engage in one another to a greater or lesser extent. For easy handling the recesses, as shown, are placed externally on the central core. However, it is also possible to provide the mouldings on the central core and the recesses on the enlargement ring.

FIGS. 11 to 15 show exemplified embodiments of the winding core according to the invention, in which for the adjustment of the cylinder height once again the axial extension of at least one interruption in the circumferential surface is adjusted. In these cases pairs of adjusting rings 60, 61 are displaced with respect to a central core 50, without there being an overlap between the central core and the rings. For this purpose adjustable fixing means or fastening means are provided between the central core and the adjusting ring in the axial extension thereof.

Figure 11:
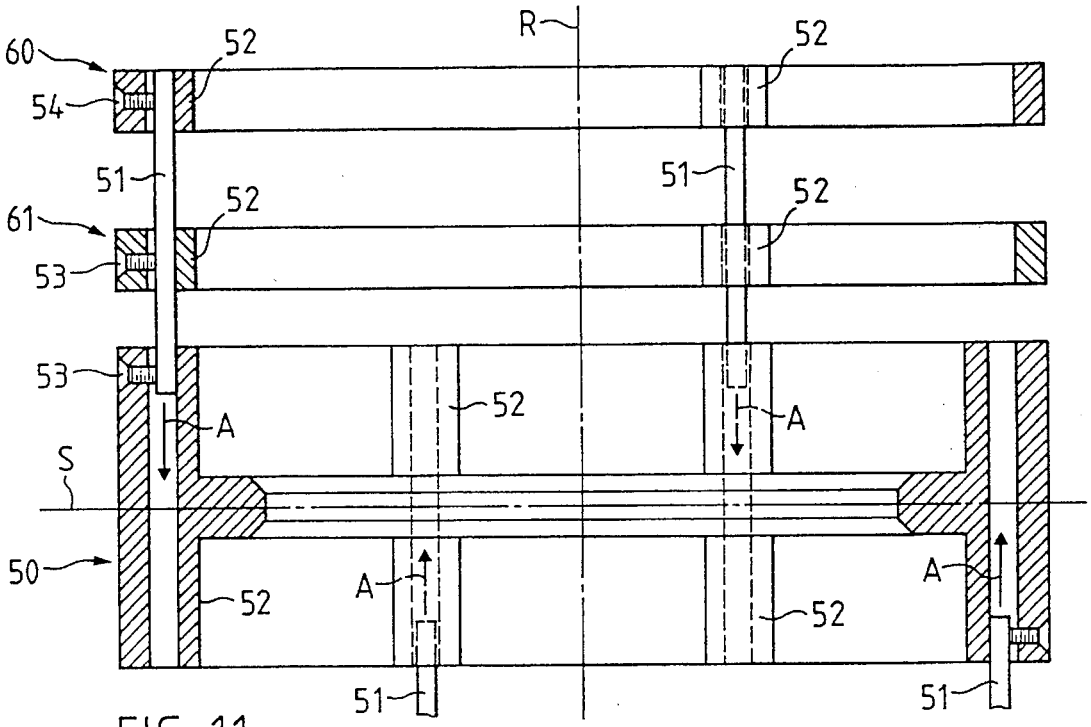
FIGS. 11 to 13 are cross sectional views of exemplified embodiments of the winding core according to the invention with a central core and adjusting rings, without overlap.

FIG. 11 shows an embodiment of the winding core according to the invention with in each case two rings 60, 61, displaceable on rods 51, relative to a central core 50. As indicated by the arrows A, the rods are insertable for reducing the cylinder height into inner mouldings 52 of the central core 50 or in corresponding holes or bores in a generally thicker wall and can be extracted therefrom for increasing the cylinder height. The rods 51 are for example fixable with fixing screws 53 in a given extraction position. The rings 60, 61 advantageously have the same or similar inner mouldings 52 to the central core 50 and through which pass the rods 51, the axially outermost ring 60 being fixed to the rod ends e.g. by means of fixed screws 54 and the inner ring 61, which is displaceable along the rods, can be fixed by fixing screws 53 in a specific position. Obviously it is possible to have different, partly detachable fixing means with which the rods can be fixed in the mouldings of the central core and the rings on the rods. Obviously it is possible to have on either side of the central core in each case more than two rings 60, 61 or only a single ring.

The spacings between the central core 50 and the inner ring 61 and between the rings 60 and 61 are advantageously regularly adjusted by corresponding positioning of the ring 61. The adjustment of such a core from one cylinder height to another is relatively complicated, because for each rod 51 and for each inner ring 61 in each case at least one fixing means must be detached and reactivated. If the fixing means are e.g. elastic clips, the effort is much smaller than in the case of fixing screws.

Figure 12:
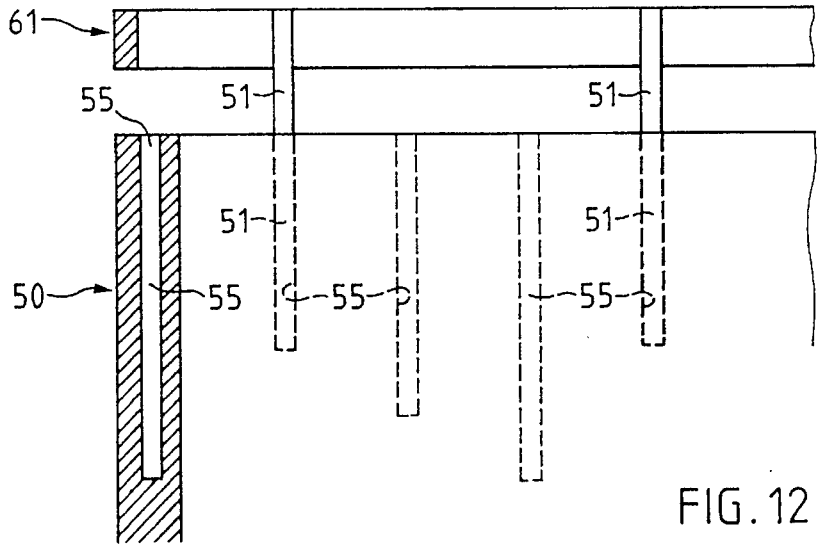

FIG. 12 shows an embodiment having a similar construction to that of FIG. 11, but whose adjustment is somewhat easier. Instead of the rods 51 being countersinkable to a random depth in mouldings, for the rods in the wall of the central core 50 or in corresponding mouldings axially directed holes 55 of different depths are distributed over the circumference and in each case the same number of holes of the same depth as there are rods, e.g. three. Certain cylinder heights can be adjusted by extracting the rods 51 from the holes 55, rotating the arrangement of adjusting rings and rods relative to the central core and reinserting the same in holes 55 having a different depth. If the rods fit very well in the holes no fixing means are required. In order that the rods are fixed in the holes, said rods can be provided with elastically deformable parts, which deform in corresponding extensions of the holes.

Figure 13:
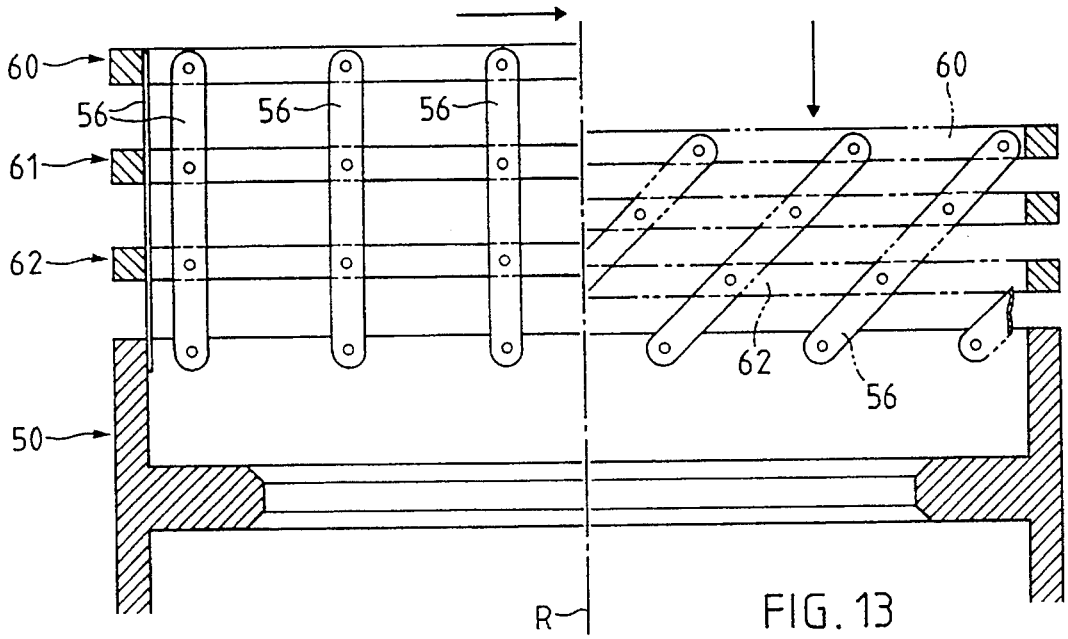

FIG. 13 shows an embodiment of the winding core according to the invention, in which there is once again a random number for example, three pairs of adjusting rings 60, 61 and 62 displaceable on either side of the central core 50. The central core 50 and the rings 60 to 62 are connected to one another in spaced manner by means of bands 56, for example of spring steel bendable around the radius of the core, but stiff in other directions and mainly with connections permitting a relative rotation between the steel band 56 and the central core 50 or rings 60, 61 or 62. For the greatest cylinder height the bands 56 are axially oriented and the central core 50 and rings 60 to 62 have the maximum spacings from one another (as shown by the continuous lines in FIG. 13). For reducing the cylinder height the outermost ring 60 is turned with respect to the central core 50, so that the steel bands are spirally oriented and the spacings between the central core 50 and the rings 60 to 62 decrease (as shown by the dotted lines in FIG. 13). For fixing a specific rotational position of the adjusting rings it is sufficient in theory to block only one of the rotary connections using random means. However, in practice it is advantageous to block more than one rotary connection.

Compared with the embodiment of FIGS. 11 or 12 the adjustment in the embodiment according to FIG. 13 is accomplished much more easily, because during adjustment, a regular spacing between the adjusting rings is automatically set. The character of the circumferential surface with several interruptions, wider or narrower as a function of the cylinder height, is the same. Here again an embodiment with a single ring 60 is conceivable, whose adjustment is no easier and whose disadvantage through the wide interruption of the circumferential surface is the same as in the embodiment according to FIG. 11 or 12 with a single or adjusting ring.

Figure 14:
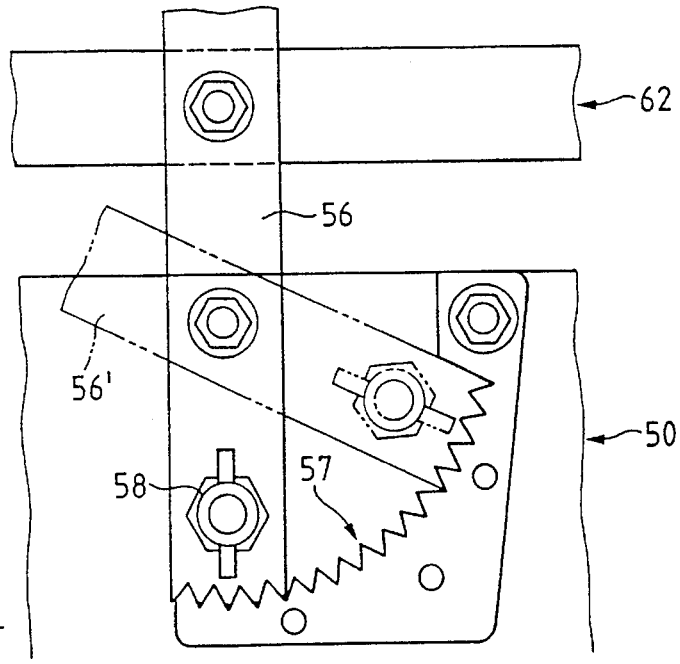
FIG. 14 shows exemplified fixing means for the embodiment of the winding core according to the invention shown in FIG. 13.

FIG. 14 shows an exemplified fixing means for the winding core of FIG. 13. It is a jig 57, which in the vicinity of the rotary fastening of one of the bands 56 (shown in two positions 56, 56') is located on the inner surface of the central core 50 and whose border shape is identical to of that of the end region of the band 56, that is, the jig includes a row of prongs. With the aid of a set screw 58 the end regions of the band are raised from the jig (from the paper plane of the representation), so that the band and therefore all the other bands are rotatable with respect to the central core. In the desired rotary position the end region of the band is again lowered into the jig and consequently the core is fixed with the desired cylinder height.

Figure 15A:
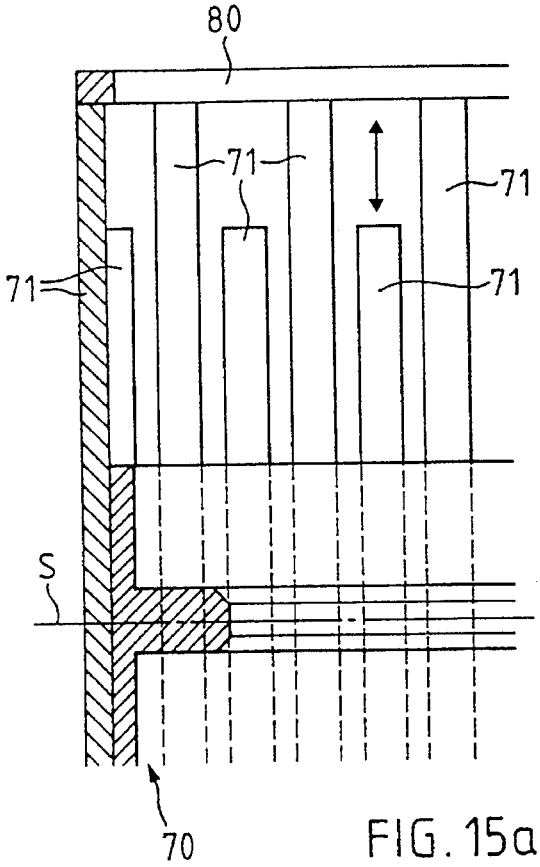
FIGS. 15*a* and 15*b* are cross sectional views of an exemplified embodiment of the winding core according to the invention with axially aligned jacket elements.
Figure 15B:
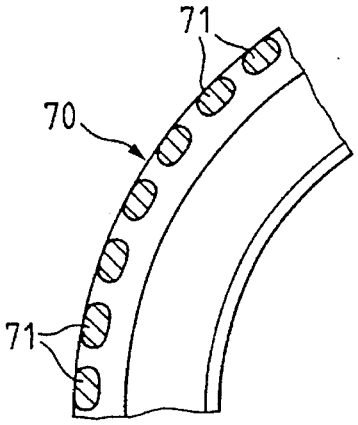

FIGS. 15*a* and 15*b* show a further exemplified embodiment of the winding core according to the invention, in which the circumferential surface comprises a plurality of narrow jacket elements 71 axially displaceable relative to one another, which are guided in axially oriented channels in the central core 70 and in the two axial outer ends are alternately retained by in each case one outer ring 80. FIG. 15*a* shows part of a section along the rotation axis, FIG. 15*b* part of a section parallel to the plane of symmetry S through the central core 70.

FIG. 15*b* makes it clear that the jacket elements 71 advantageously have a cross-section which, on an outer area, has a curvature corresponding to the core radius and which is surrounded by the central core wall over a circumference of more than 180°. It is advantageous if the central core wall projects over the jacket elements radially to a very limited extent, so that the circumferential surface is slightly uneven in the vicinity of the central core, but as a result the force acting on the jacket elements as a result of winding the winding band thereon is reduced and a displacement of the elements is not excessively impeded. Walls for central core 70 and jacket element 71, as shown in FIGS. 15*a* and 15*b*, are for example manufacturable from plastic and the jacket elements 71 are insertable by the elastic deformation of the wall of the central core in the openings or channels provided and axially displaceable therein, without needing special fixing means.

The advantage of an embodiment according to FIGS. 15*a* and 15*b* is that the circumferential surface interruptions only extend over very short distances over the circumference (widths of the jacket elements), so that they can without harm assume a greater extension in the axial direction.

Figure 16:
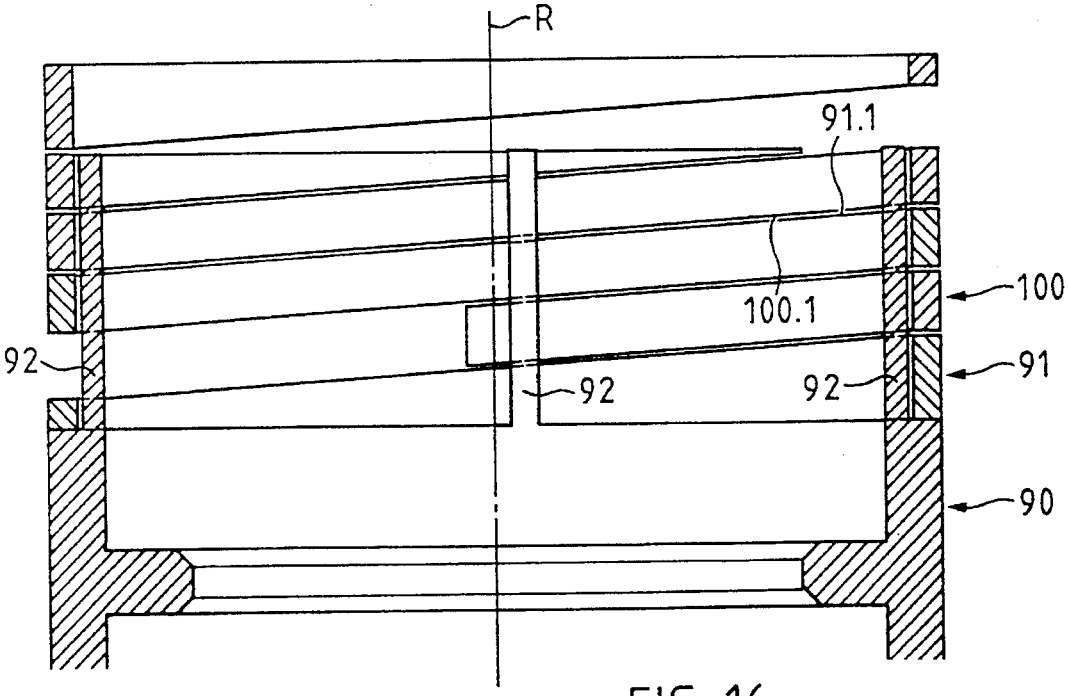
FIG. 16 are cross sectional views of an exemplified embodiment of the winding core according to the invention with spirally arranged jacket elements.

FIG. 16 shows an embodiment of the winding core according to the invention, which once again comprises narrow jacket elements, but which in this embodiment are arranged spirally. The winding core comprises a central core 90, on which are located on either side core spirals 91, which have the same external diameter as the central core 90. In core spirals 91, correspondingly constructed adjusting spirals 100 with the same external diameter are arranged in rotary manner, which by rotation against the central core 90 and simultaneous screwing in or out with respect to the core spirals 91 are used for adjusting the cylinder height.

Advantageously the spirals 91 and 100 are held in a coaxial position or connected coaxially by supports or brackets 92 located in the vicinity of the core spirals 91 and are constructed in such a way that it is not possible to completely rotate the adjusting spirals 100 out of the core spirals. In place of the supports 92 it is possible to provide correspondingly shaped, interengaging contact faces 91.1 and 100.1, or which are obliquely oriented with respect to the rotation axis, between the spirals 91 and 100, which can be manufactured from plastic and can also be introduced into one another if the material is sufficiently elastic. The cross-section of the spiral turns is advantageously such that they form a smooth circumferential surface, but in such a way that they have an axially oriented, linear boundary at least against the outer circumference.

If the spirals 91 and 100 fit very well in one another and their pitch is not excessive, the self-locking of the system can suffice in order to fix the spirals in any reciprocal position.

The embodiment according to FIG. 16 has a relatively complicated manufacture. Its advantage is that the width of the circumferential surface interruptions does not exceed the width of the spiral convolutions, moreover the different cylinder heights can be adjusted easily. As a function of the particular design, also in this embodiment the stiffness with respect to the rotation axis can limit the use possibilities.

Figure 17:
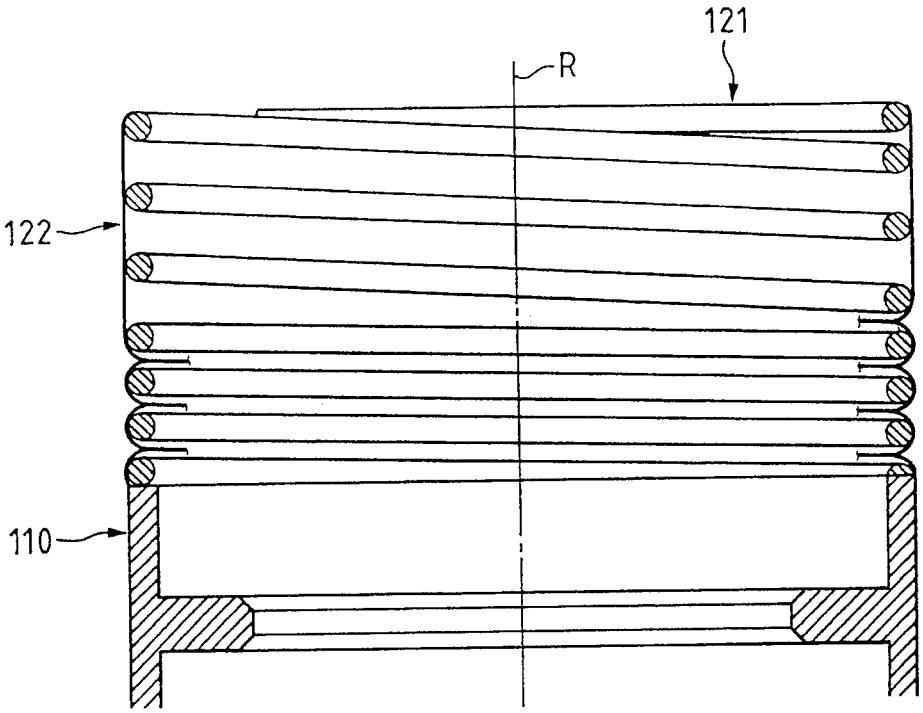
FIGS. 17 to 19 are cross sectional views of exemplified embodiments of the winding core according to the invention with circumferential surface parts which can be folded down.
Figure 18:
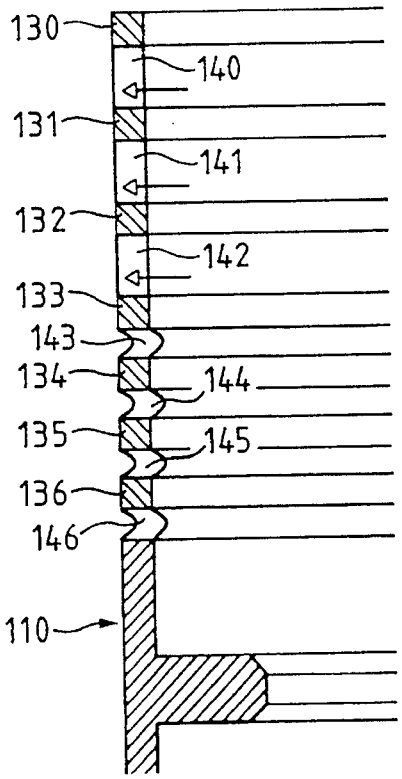
Figure 19:
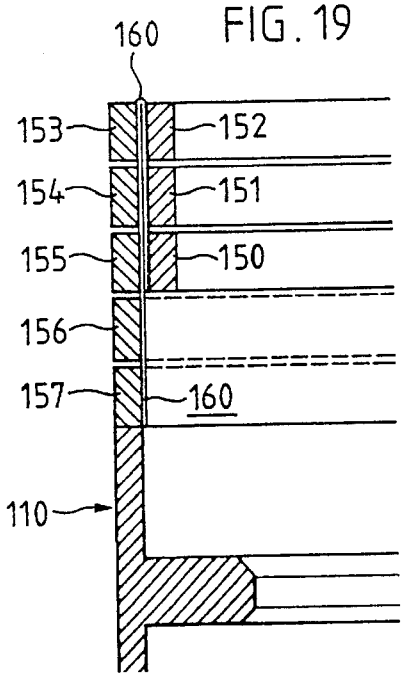

FIGS. 17 to 19 show exemplified embodiments of the winding core according to the invention having circumferential surface parts which can be folded down and away toward the retaining means and whose cylinder height is varied in that a corresponding number of said circumferential surface parts are folded down. All the embodiments according to FIGS. 17 to 19 have in their axially outer areas of the circumferential surface a limited stiffness with respect to the rotation axis, so that they cannot be excessively radially stressed.

FIG. 17 shows such an embodiment based on the principle of a spiral spring 121 drawn around the outer circumference thereof with a diaphragm and which is located on either side on a central core 110. In the state shown in the top part of the drawing the spiral spring 121 is extended, i.e. untensioned or uncompressed and on applying an axial tension is compressed (in the lower part of the drawing). The diaphragm 122 is so elastically pretensioned that in the case of a compression of the spiral spring 121 it folds against a smaller radius, i.e. away from the circumferential surface. In the untensioned state of the spiral spring 121 the diaphragm 122 is axially stretched and forms the circumferential surface. Between pairs of adjacent turns of the spiral spring 121 are provided on the inside thereof spring fixing means (not shown) with in each case two fixing positions, for example in the form of double hooks, with which the turns can be fixed either in the compressed state with folded away diaphragm or circumferential surface part between them, or in the untensioned state with folded down diaphragm or circumferential surface part between them.

The ratio of the number of turns with folded away diaphragm part and the number of turns with folded down diaphragm part determines the cylinder height of this embodiment of the winding core according to the invention.

FIG. 18 shows another embodiment of the winding core according to the invention, once again with circumferential surface parts which can be folded down and away. The winding core once again has a central core 110 and a plurality of adjusting rings 130 to 136, which are interconnected by collars 140 to 146 subject to compressed air action. If the collars are under pressure, they represent a circumferential surface part, but if they are not under pressure they are folded against the core interior due to their elasticity. The collars can be individually equipped with a compressed air supply valve or they can be connected in series to a common supply system. In such a case it is advantageous to fit between the supply lines of the individual collars shutoff valves, which only open when the adjacent collar is filled. In such a system on filling with compressed air the number of filled collars necessary for a desired cylinder height can easily be adjusted by the quantity of compressed air supplied.

FIG. 19 shows another embodiment of the winding core according to the invention with circumferential surface parts which can be folded down or away. Once again the winding core has a central core 110, on which are arranged on either side a plurality of elastic rings 150 to 157 by means of a diaphragm 160 stretched over the rings on the inside. The rings are so elastic that they can be compressed to a smaller radius, i.e. can be inverted into the cylinder interior. The diaphragm is positioned in such a way that it retains the rings with very small axial spacings, but can be bent inwards between all the rings. The diaphragm is so inelastic in the radial direction that it absorbs the elastic force of the compressed, inverted rings, so that they do not press against the outer rings and remain displaceable against the same. The number of inwardly inverted rings determines the cylinder height.

As stated, the selected number of described, exemplified embodiments does not restrict the invention, because numerous combinations and variants of the described constructions can be readily implemented by the expert.

I claim:

1. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core;

adjusting means operatively connected to the central core for adjusting the axial length of the winding core by varying in the axial direction one of a circumferential surface of the winding core and gap lengths of gaps defined in the circumferential surface of the winding core, the adjusting means comprising at least one pair of enlargement rings including:

a first enlargement ring fixed at a first end of the central core;

a second enlargement ring fixed at a second, opposite end of the central core; and attaching means disposed on the first enlargement ring and the second enlargement ring for attaching the enlargement rings to at least one of the central core and one another, the attaching means including one of threads, elastic snap closures, closeable groove-and-tongue joints and bayonet catches; and retaining means disposed in the cylinder cavity.

2. The winding core according to claim 1, wherein the adjusting means include fixing means for fixing an adjusted length of the winding core.

3. The winding core according to claim 1, wherein the at least one pair of enlargement rings includes a plurality of pairs of enlargement rings.

4. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core having a circumference;

adjusting means operatively connected to the central core for adjusting the axial length of the winding core by varying in the axial direction one of a circumferential surface of the winding core and gap lengths of gaps defined in the circumferential surface of the winding core, the adjusting means comprising a plurality of pairs of adjusting rings having a circumference and including:

a first set of a adjusting rings fixed at a first end of the central core;

a second set of adjusting rings fixed at a second, opposite end of the central core; and overlapping interconnections defined among the central core, the first set of adjusting rings, and the second set of adjusting rings, a length of each of the overlapping interconnections being adjustable; and retaining means disposed in the cylinder cavity.

5. The winding core according to claim 4, wherein the overlapping interconnections include threads disposed about an entirety of the circumference of each of the central core and the adjusting rings.

6. The winding core according to claim 4, wherein each of the overlapping interconnections extends over at least several portions of the circumference of each of the central core and the adjusting rings, the adjusting means further including a plurality of closure means disposed at the overlapping interconnections for fixing an adjusted length of each of the overlapping interconnections, the closure means including one of snap closures, closeable groove and tongue joints, bayonet catches and plug connections.

7. The winding core according to claim 4, wherein each of the overlapping interconnections extends over at least several portions of the circumference of each of the central core and the adjusting rings, the adjusting means further including a plurality of both moldings and slots disposed at the overlapping interconnections, the slots being oriented in one of a spiral direction and an axial direction, the moldings further being movable in the slots for adjusting a length of each of the overlapping interconnections.

8. The winding core according to claim 7, wherein the adjusting means include fixing means for fixing an adjusted length of the winding core, the fixing means including threads disposed on the moldings and fixing nuts fitted onto the threads.

9. The winding core according to claim 4, wherein the adjusting means further include a plurality of connection sets, each connection set comprising a pair of axially oriented moldings having identical axial lengths, and a corresponding pair of axially oriented passages having identical axial lengths, the connection sets being disposed at the overlapping interconnections at the circumference of respective ones of the central core and the adjusting rings, the moldings in each connection set being matable with passages in every connection set for adjusting a length of the overlapping interconnections.

10. The winding core according to claim 4, wherein the adjusting means further include a plurality of both moldings and slots having corresponding stepped boundaries in an axial direction.

11. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core having a circumference;

adjusting means operatively connected to the central core for adjusting the axial length of the winding core by varying in the axial direction one of a circumferential surface of the winding core and gap lengths of gaps defined in the circumferential surface of the winding core, the adjusting means comprising a plurality of pairs of adjusting rings having a circumference and including:

a first set of a adjusting rings fixed at a first end of the central core;

a second set of adjusting rings fixed at a second, opposite end of the central core; and fastening means for varying an axial distance between at least one of an adjusting ring and the central core, and respective adjusting rings, the fastening means including bands connecting the central core and the adjusting rings, the bands being bendable only in a circumferential direction with respect to the central core and the adjusting rings for allowing a rotational displacement therebetween, the bands thereby defining respective rotational positions of the central core and the adjusting rings; and retaining means disposed in the cylinder cavity.

12. The winding core according to claim 11, wherein the fastening means further include:

a jig for fixing the respective rotational positions of the central core and the adjusting rings, the jig being disposed on an inner surface of the central core, at least one of the bands having an end region being disposed on the jig, the jig further having a border corresponding in shape to the end region of the at least one of the bands; and a means for raising the end region of that at least one of the bands away from the jig for allowing a rotational displacement between the central core and the adjusting rings.

13. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core;

adjusting means operatively connected to the central core for adjusting the axial length of the winding core by varying in the axial direction one of a circumferential surface of the winding core and gap lengths of gaps defined in the circumferential surface of the winding core, the adjusting means comprising:

axially oriented channels disposed in the central core;

axially oriented jacket elements axially displaceable within the channels of the central core, each of the jacket elements having an inner end and an outer end; and two outer rings, each of the outer rings being disposed at outer ends of alternate ones of the jacket elements at either side of the central core; and retaining means disposed in the cylinder cavity.

14. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core;

adjusting means operatively connected to the central core for adjusting the axial length of the winding core by varying in the axial direction one of a circumferential surface of the winding core and gap lengths of gaps defined in the circumferential surface of the winding core, the adjusting means comprising:

core spirals connected to the central core on either side thereof and having an external diameter identical to an external diameter of the central core;

adjusting spirals located in between the core spirals and having an external diameter identical to the external diameter of the central core, the adjusting spirals being rotatable for adjusting the length of the winding core; and retaining means disposed in the cylinder cavity.

15. The winding core according to claim 14, wherein the adjusting means further includes means for coaxially connecting the adjusting spirals to the core spirals, the means for coaxially connecting including one of a support upon which the spirals are mounted, engaging portions disposed on the spirals for engaging respective engaging portions of adjacent spirals, and contacting portions of adjacent spirals oriented obliquely with respect to the longitudinal axis of the winding core.

16. The winding core according to claim 14, wherein the spirals have an outer circumference whose cross section in a plane parallel to the longitudinal axis of the winding core defines linear boundaries which are parallel to the longitudinal axis of the winding core.

17. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core;

adjusting means operatively connected to the central core for adjusting the axial length of the winding core by varying in the axial direction one of a circumferential surface of the winding core and gap lengths of gaps defined in the circumferential surface of the winding core, the adjusting means comprising circumferential surface parts which can be folded down toward the retaining means; and retaining means disposed in the cylinder cavity.

18. The winding core according to claim 17, wherein the circumferential surface parts include adjusting rings and collars disposed between the adjusting rings, the collars being pressurizeable to vary a distance between the adjusting rings.

19. The winding core according to claim 17, wherein the adjusting means further include elastic rings and a diaphragm stretched over an inner surface of the elastic rings to effect a connection therebetween, the elastic rings being invertible into the cylinder cavity of the winding core.

20. A winding core for winding flat articles, the winding core being substantially cylindrical and hollow thereby defining a longitudinal axis and a cylinder cavity and having an axial length, the winding core further being rotatable about its longitudinal axis and symmetrical with respect to a plane of symmetry S perpendicular to its longitudinal axis, the winding core comprising:

a central core;

adjusting means operatively connected to the central core for adjusting the axial length of the winding core by varying in the axial direction one of a circumferential surface of the winding core and gap lengths of gaps defined in the circumferential surface of the winding core, the adjusting means comprising a spiral spring disposed on each end of the central core and including turns and a diaphragm for covering the turns, and spring fixing means for fixing pairs of turns of respective springs to one another in both a compressed state where the diaphragm is folded away between the turns, and in an uncompressed state where the diaphragm is stretched between the turns; and retaining means disposed in the cylinder cavity.

* * * * *